US008459763B2

(12) United States Patent
Yamanobe

(10) Patent No.: US 8,459,763 B2
(45) Date of Patent: Jun. 11, 2013

(54) IMAGE RECORDING APPARATUS AND IMAGE RECORDING METHOD

(75) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 79 days.

(21) Appl. No.: 13/159,438

(22) Filed: Jun. 14, 2011

(65) Prior Publication Data

US 2011/0316909 A1 Dec. 29, 2011

(30) Foreign Application Priority Data

Jun. 25, 2010 (JP) ..... 2010-145190

(51) Int. Cl.
*B41J 25/308* (2006.01)

(52) U.S. Cl.
USPC ..... 347/8

(58) Field of Classification Search
CPC ..... B41J 11/007
USPC ..... 347/8, 16, 101, 104
See application file for complete search history.

(56) References Cited

U.S. PATENT DOCUMENTS 6,666,536 B2 * 12/2003 Nakanishi et al. ..... 347/8
7,434,927 B2 * 10/2008 Sakuma et al. ..... 347/104
8,162,425 B2 * 4/2012 Kato et al. ..... 347/8

FOREIGN PATENT DOCUMENTS

JP 2007-22019 A 2/2007
JP 2009-226839 A 10/2009

* cited by examiner

*Primary Examiner* — An Do
(74) *Attorney, Agent, or Firm* — SOLARIS Intellectual Property Group, PLLC

(57) ABSTRACT

An image recording apparatus of the present invention includes: a conveying unit that conveys a recording medium; a conveying speed detection unit that detects a conveying speed of the recording medium; a conveying control unit that controls the conveying unit so as to accelerate or decelerate the conveying speed of the recording medium detected by the conveying speed detection unit between a stationary state and a constant speed state; a recording unit that faces the recording medium and records an image; a recording control unit that varies a recording frequency of the recording unit according to the conveying speed of the recording medium; and a throw distance control unit that controls a throw distance between the recording unit and a recording face of the recording medium according to the conveying speed of the recording medium.

23 Claims, 5 Drawing Sheets

FIG.5

| TIME | $N^{th}$ DROPLET | $N+1^{th}$ DROPLET |
|---|---|---|
| t0[ms] | 0 EJECTION | — |
| $t1=t0+\frac{h(t0)}{V}$ | h(t0) IMPACT | — |
| $t2=t3-\frac{h(t2)}{V}$ | — | 0 EJECTION |
| $t3=t1+\frac{25.4}{P\langle v(t1,t3)\rangle}$ | — | h(t2) IMPACT |

JETTING INTERVAL $\Delta t=t2-t0=\frac{h(t0)-h(t2)}{V}+\frac{25.4}{P\langle v(t0,t2)\rangle}$ [ms]

JETTING FREQUENCY $f=1/\Delta t=1/\{(h(t0)-h(t2))/V+25.4/P\langle v(t0,t2)\rangle\}$ $$f=\frac{1}{\Delta t}=\frac{1}{\frac{h(t0)-h(t2)}{V}+\frac{25.4}{P\langle v(t0,t2)\rangle}}\ [\mathrm{kHz}]$$

* $\langle v(t1, t2)\rangle$ IS THE AVERAGE SPEED FROM TIME t1 TO TIME t2

$\langle v(t1,t3)\rangle=\langle v(t0,t2)\rangle$

P [dpi] : RECORDING DENSITY (RECORDING RESOLUTION)
v(t)[m/s] : CONVEYING SPEED OF WEB P (RECORDING MEDIUM)
h(t)[mm] : TD(Throw Distance)
V[m/s] : FLIGHT SPEED OF LIQUID DROPLET
f(t)[kHz] : JETTING FREQUENCY

IMAGE RECORDING APPARATUS AND IMAGE RECORDING METHOD

CROSS-REFERENCE TO RELATED APPLICATION

This application claims priority under 35 USC 119 from Japanese Patent Application No. 2010-145190 filed on Jun. 25, 2010, the disclosure of which is incorporated by reference herein.

BACKGROUND

1. Technical Field

The present invention relates to an image recording apparatus and an image recording method.

2. Related Art

An image recording apparatus has been described for recording text information or images on a recording medium by conveying a recording medium such as recording paper in a conveying direction, and recording on the recording medium by a method such as jetting ink droplets or applying impacts in dot units with a head that faces towards a recording face (see for example Japanese Patent Application Laid-Open (JP-A) No. 2007-22019). In this image recording apparatus a processing liquid is applied to the recording face of the recording medium to achieve higher quality images, and the recording head to recording medium distance is changed in order to prevent smudging occurring on the recording face due to contact or interference between the recording medium and the head(s).

There is also another image recording apparatus described in which means is provided for detecting signs of slackness in recording paper (continuous paper), increasing the throw distance between the head(s) and the recording paper when slackness of the paper is detected so as to prevent contact or interference between the recording paper and head(s) (see for example JP-A No. 2009-226839).

However, when there is a constant recording density with the head(s), unless the conveying speed for conveying the recording paper is also constant poor image quality with variation of the output image in the conveying direction results. In order to address this issue, in the image recording apparatus of JP-A No. 2009-226839, for example, a configuration is adopted in which the head(s) are lowered and moved to the recording position only after the recording paper conveying speed has achieved a recordable speed, and then recording is started. The head(s) are also lifted and moved to the standby position only after recording has been completed, and then recording paper conveying is stopped.

With a procedure such as described above there is no recording performed on the recording paper until the recording paper conveying speed has achieved a specific speed, namely while accelerating or decelerating. The recording paper conveyed during such intervals becomes "broke" and recording paper is wasted. Since broke increases according to both the acceleration duration and the recording speed, this leads to increased cost particularly for high speed recording.

However, were the head(s) to be moved to the recording position before accelerating the recording medium, since there is a possibility of the recording paper flapping during acceleration, consideration should be given to resulting problems such as contact or interference of the recording paper to the head(s), occurrences of poor imaging and damage to the heads.

SUMMARY

The present invention is made consideration of the above circumstances and provides an image recording apparatus and an image recording method for suppressing the amount of broke, and for preventing occurrences of poor images and damage to heads.

An image recording apparatus of a first aspect of the present invention includes: a conveying unit that conveys a recording medium; a conveying speed detection unit that detects a conveying speed of the recording medium; a conveying control unit that controls the conveying unit so as to accelerate or decelerate the conveying speed of the recording medium detected by the conveying speed detection unit between a stationary state and a constant speed state; a recording unit that faces the recording medium and records an image; a recording control unit that varies a recording frequency of the recording unit according to the conveying speed of the recording medium; and a throw distance control unit that controls a throw distance between the recording unit and a recording face of the recording medium according to the conveying speed of the recording medium.

According to the first aspect of the present invention, broke can be suppresses to a smaller amount, and occurrences of poor imaging and head damage can be prevented.

In an image recording apparatus of a second aspect of the present invention, during acceleration of the recording medium the recording unit records the image while the throw distance control unit decreases the throw distance between the recording unit and the recording medium.

According to the second aspect of the present invention, recording can be performed during acceleration of the recording medium, and broke can be reduced.

In an image recording apparatus of a third aspect of the present invention, during deceleration of the recording medium the recording unit records the image while the throw distance control unit increases the throw distance between the recording unit and the recording medium.

According to the third aspect of the present invention, recording can be performed during deceleration of the recording medium, and broke can be reduced.

In an image recording apparatus of a fourth aspect of the present invention, during acceleration of the recording medium a rate of change in speed decreases as the conveying speed increases.

According to the fourth aspect of the present invention, due to being able to reduce flapping of the recording medium to a small amount when the TD (a separation from the recording medium to recording unit separation) has become close, the possibility of contact or interference between the recording medium and the recording unit can be reduced.

In an image recording apparatus of a fifth aspect of the present invention, during deceleration of the recording medium a rate of change in speed increases as the conveying speed decreases.

According to the fifth aspect of the present invention, due to being able to suppress flapping of the recording medium to a small amount when the TD has become close, the possibility of contact or interference between the recording medium and the recording unit can be reduced.

In an image recording apparatus of a sixth aspect of the present invention, during acceleration or deceleration of the recording medium the conveying control unit and the recording control unit change a recording frequency according to the throw distance between the recording unit and the recording medium.

According to the sixth aspect of the present invention, the image recording density can be accurately controlled even during acceleration or deceleration of the recording medium.

In an image recording apparatus seventh aspect of the present invention: the throw distance control unit changes a position of the recording unit in at least three stages that include a standby position at a greatest throw distance from the recording medium, a recordable position that is closer to the recording medium than the standby position, and a recording position that is closer to the recording medium than the recordable position; while the recording unit is positioned between the standby position and the recordable position, the conveying control unit stops conveying of the recording medium; while the recording unit is positioned between the recordable position and the recording position, the conveying control unit accelerates or decelerates the recording medium and the recording control unit makes the recording unit record the image on the recording face while changing the recording frequency of the recording unit; and while the recording unit is positioned at the recording position, the conveying control unit conveys the recording medium at a constant speed and the recording control unit makes the recording unit record the image on the recording face while maintaining a constant recording frequency of the recording unit.

According to the seventh aspect of the present invention, contact or interference between the recording medium and the recording unit can be prevented due to being able to adjust the separation between the recording medium and the recording unit to an amount appropriate to the conveying speed of the recording medium.

An image recording apparatus of an eighth aspect of the present invention includes a drying unit that heats and dries the recording medium after image recording, wherein an intensity of drying of the drying unit is lower during acceleration or deceleration of the recording medium than during conveying at a constant speed.

According to the eighth aspect of the present invention, excessive drying can be prevented even during acceleration or deceleration of the recording medium when the conveying speed is low.

An image recording apparatus of the ninth aspect of the present invention includes a processing liquid coating unit that coats a processing liquid to the recording face and a processing liquid drying unit that dries the processing liquid applied to the recording face before image recording, wherein an intensity of drying of the processing liquid drying unit is lower during acceleration or deceleration of the recording medium than during conveying at a constant speed.

According to the ninth aspect of the present invention, excessive drying can be prevented even during acceleration or deceleration of the recording medium when the conveying speed is low.

In an image recording apparatus of a tenth aspect of the present invention, the recording medium conveyed by the conveying unit is continuous paper.

According to the tenth aspect of the present invention, an image recording apparatus is achieved that can suppress broke to a small amount, and prevent occurrences of poor imaging and head damage during continuous paper processing.

In an image recording apparatus of an eleventh aspect of the present invention: the throw distance control unit is a raising and lowering mechanism that raises or lowers the recording unit; the recording unit comprises a recording head with a support hole that passes through the recording head and is parallel to the recording face of the recording unit; and the raising and lowering mechanism comprises an eccentric cam core with an eccentric rotating shaft that is inserted rotatably into the support hole.

According to the eleventh aspect of the present invention, the throw distance control unit can be configured with a simple configuration.

In a radiographic imaging apparatus of a twelfth aspect of the present invention: an elongated hole is formed in the recording head along a raising and lowering direction of the raising and lowering mechanism; and the raising and lowering mechanism comprises a guide pin that is inserted into the elongated hole, wherein the guide pin effects guidance such that the recording head only moves in the raising and lowering direction.

According to the twelfth aspect of the present invention, disturbance to the orientation of the recording head can be prevented when the eccentric cam is rotated by driving means, such as a stepping motor, pressing up the inner wall of the support hole.

In an image recording apparatus of a thirteenth aspect of the present invention: the throw distance control unit is a raising and lowering mechanism that raises or lowers the recording unit; the recording unit comprises a recording head with a threaded hole that passes through the recording head in a raising and lowering direction of the raising and lowering mechanism; and the raising and lowering mechanism comprises a shaft that extends in the raising and lowering direction and that is threadably engaged with the threaded hole.

According to the thirteenth aspect of the present invention, the throw distance control unit can be configured with a simple configuration.

In an image recording apparatus of a fourteenth aspect of the present invention, the raising and lowering mechanism further comprises a guide pin that passes through an end portion of the recording head in the raising and lowering direction, and the guide pin effects guidance such that the recording head only moves in the raising and lowering direction.

According to the fourteenth aspect of the present invention, disturbance to the orientation of the recording head can be prevented when the shaft is threadably engaged with the threaded hole is rotated and the recording head is being raised or lowered.

An image recording method of a fifteenth aspect of the present invention includes: conveying a recording medium; detecting a conveying speed of the recording medium; accelerating or decelerating the detected conveying speed of the recording medium between a stationary state and a constant speed state; recording an image with a recording unit disposed facing the recording medium; varying a recording frequency of the recording unit according to the conveying speed of the recording medium; and controlling a throw distance between the recording unit and a recording face of the recording medium according to the conveying speed of the recording medium.

According to the fifteenth aspect of the present invention, broke can be suppresses to a small amount, and occurrences of poor imaging and head damage can be prevented.

In an image recording method of a sixteenth aspect of the present invention, during the accelerating of the recording medium the recording unit records the image while the throw distance between the recording unit and the recording medium decreases.

According to the sixteenth aspect of the present invention, recording can be performed during acceleration of the recording medium, and broke can be reduced.

In an image recording method of a seventeenth aspect of the present invention, during the decelerating of the recording medium the recording unit records the image while the throw distance between the recording unit and the recording medium increases.

According to the seventeenth aspect of the present invention, recording can be performed during deceleration of the recording medium, and broke can be reduced.

In an image recording method of an eighteenth aspect of the present invention, during the accelerating of the recording medium a rate of change in speed decreases as the conveying speed increases.

According to the eighteenth aspect of the present invention, due to being able to reduce flapping of the recording medium to a small amount when the TD has become close, the possibility of contact or interference between the recording medium and the recording unit can be reduced.

In an image recording method of an nineteenth aspect of the present invention, during the decelerating of the recording medium a rate of change in speed increases as the conveying speed decreases.

According to the nineteenth aspect of the present invention, due to being able to suppress flapping of the recording medium to a small amount when the TD has become close, the possibility of contact or interference between the recording medium and the recording unit can be reduced.

In an image recording method of twentieth aspect of the present invention, during the accelerating or decelerating of the recording medium a recording frequency is changed according to the throw distance between the recording unit and the recording medium.

According to the twentieth aspect of the present invention, the image recording density can be accurately controlled even during acceleration or deceleration of the recording medium.

In an image recording method of a twenty-first aspect of the present invention, a position of the recording unit is changed in at least three stages that include a standby position at a greatest throw distance from the recording medium, a recordable position that is closer to the recording medium than the standby position, and a recording position that is closer to the recording medium than the recordable position; while the recording unit is positioned between the standby position and the recordable position, the conveying of the recording medium is stopped; while the recording unit is positioned between the recordable position and the recording position, the recording medium is accelerated or decelerated and the recording unit records the image on the recording face while the recording frequency of the recording unit is changed; and while the recording unit is positioned at the recording position, the recording medium is conveyed at a constant speed and the recording unit records the image on the recording face while a constant recording frequency is maintained.

According to the twenty-first aspect of the present invention, contact or interference between the recording medium and the recording unit can be prevented due to being able to adjust the separation between the recording medium and the recording unit to an amount appropriate to the conveying speed of the recording medium.

An image recording method of a twenty-second aspect of the present invention includes heating and drying the recording medium after image recording, wherein an intensity of the drying is lower during acceleration or deceleration of the recording medium than during conveying at a constant speed.

According to the twenty-second aspect of the present invention, excessive drying can be prevented even during acceleration or deceleration of the recording medium when the conveying speed is low.

An image recording method of a twenty-third aspect of the present invention includes coating a processing liquid to the recording face and drying the processing liquid applied to the recording face before image recording, wherein an intensity of the drying of the processing liquid is lower during acceleration or deceleration of the recording medium than during conveying at a constant speed.

According to the twenty-third aspect of the present invention, excessive drying can be prevented even during acceleration or deceleration of the recording medium when the conveying speed is low.

BRIEF DESCRIPTION OF THE DRAWINGS

Exemplary embodiments of the present invention will be described in detail based on the following figures, wherein:

FIG. 5 illustrates equations of jetting interval and jetting frequency during acceleration of the recording medium according to an exemplary embodiment of the present invention.

DETAILED DESCRIPTION

Explanation follows regarding an exemplary embodiment of the present invention, with reference to the drawings.

(Overall Configuration)

Figure 1:
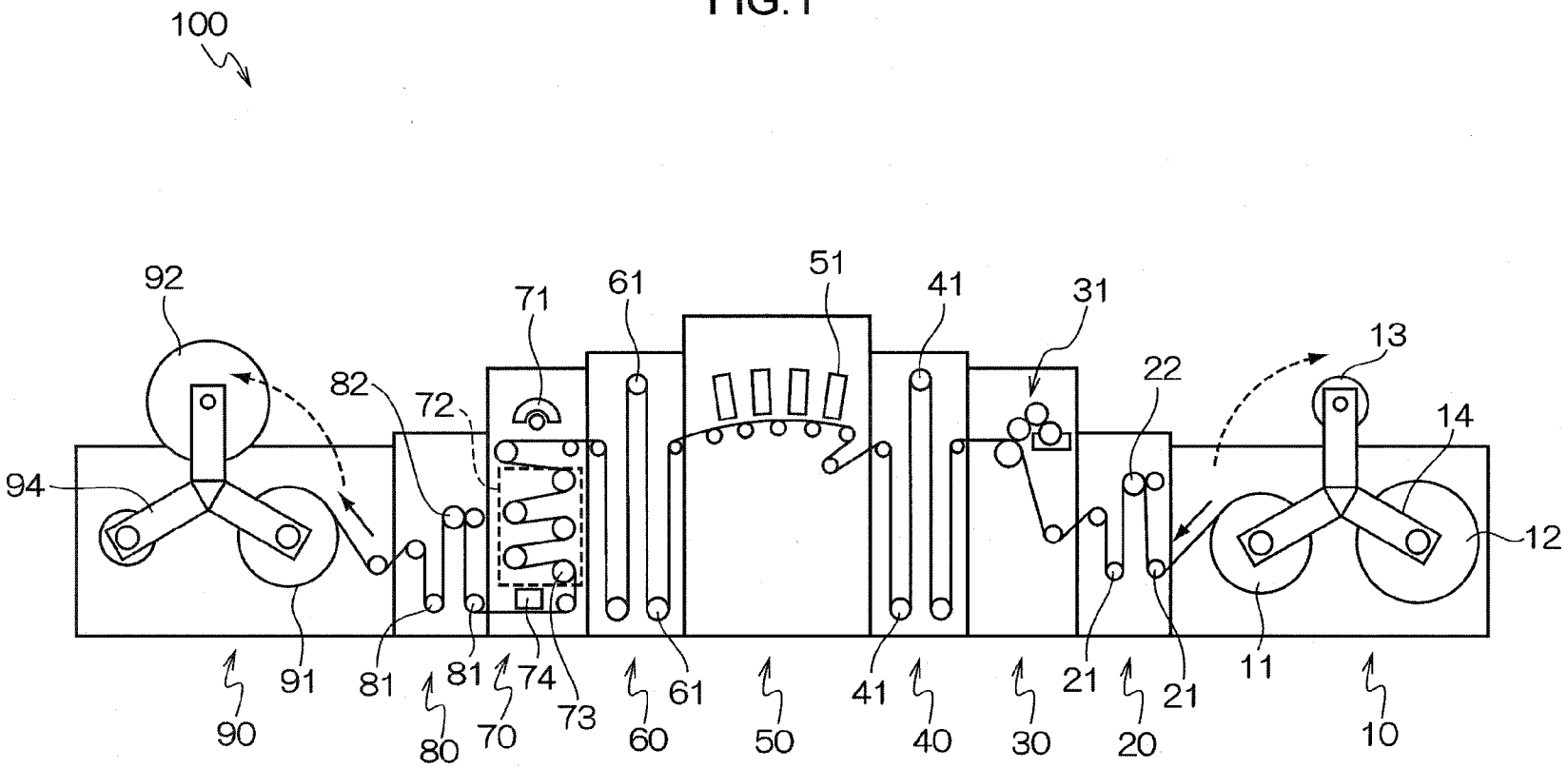
FIG. 1 is a schematic diagram illustrating relevant portions of an image recording apparatus according to an exemplary embodiment of the present invention.

As shown in FIG. 1, an image recording apparatus 100 according to the present exemplary embodiment is provided with a paper feeder section 10 for feeding out and conveying a paper web P serving as a recording medium, at the web (continuous paper) P conveying direction upstream side. At the conveying direction downstream of the paper feeder section 10 are provided, in sequence along the web P conveying direction: an in-feed section 20 for pulling out the web of the web P from the paper feeder section 10 and temporarily holding the web P; a processing liquid coating section 30 for coating a processing liquid onto the recording face of the web P; a first drying section 40 for drying the web P; an image forming section 50 for forming an image on the recording face of the web P; a second drying section 60 for drying and fixing the image to the web P; a fixing and reading section 70 for fixing the image and reading the image with a scanner or the like; an out-feed section 80 for temporarily holding the web P; and an take-up section 90 for taking up the web P to which images have been fixed.

There are no particular limitations to the recording medium employed as the web P, and general purpose printing papers having cellulose as the main component can be employed, such as general offset printing paper, high quality paper, coated paper and art paper. As stated later, there is also no limitation to roll paper, and sheets (cut paper) may also be employed.

General purpose printing paper with cellulose as a main component absorbs comparatively more ink in image recording with an ordinary inkjet method using water based inks and is slower to dry, making it susceptible to color movement after droplet impact and deterioration in image quality. However, the inkjet recording of the present invention enables color movement to be suppressed, leading to a high quality image being recorded with excellent color density and hue. Explanation now follows regarding each of the processing sections.

(Paper Feeder Section)

As shown in FIG. 1, the paper feeder section 10 is equipped with a reel stand 14 to which paper feed rolls (paper reels) 11, 12 are mounted. The reel stand 14 continuously feeds the web P (strip shaped paper) so that there is no break in continuous processing by the new paper feed roll 12 being readied when the paper feed roll 11 currently being used in the printing operation nears completion, and by then splicing together the roll paper on the old and new paper feed rolls 11, 12.

The paper feed roll 11 shown in FIG. 1 is being used, and the paper feed roll 12 is the paper feed roll prepared for use next, and a paper feed roll 13 has already finished being used and the web P thereon has been used up. The method by which old and new paper feed rolls are changed over is by rotating the arms of the reel stand 14 in the clockwise direction in the drawing, such that the paper feed roll 12 nears the running line of the web P. The peripheral speed of the paper feed roll 12 to be used next is then synchronized to the running speed of the web P, and a paper splicer, not shown in the fdrawings, is actuated. After paper splicing has been performed by pressing an adhesive portion at the leading edge of the paper feed roll 12 against the web P, the paper feed roll 11 currently being used is then moved away from the web P by a cutter in the splicer. The paper feed roll 11 thereby becomes a used paper feed roll 13.

(In-Feed Section)

As shown in FIG. 1, an in-feed roller pair 21 is provided in the in-feed section 20 for pulling the web P out from the paper feeder section 10. The rotation speeds of the in-feed roller pair 21 are settable. A dancer roller 22 is provided for adjusting the tension of the web P. The dancer roller 22 is swung up or down in the drawing and held by an actuator, not shown in the drawings, in order to temporarily store the web P of an adjustment amount required during splicing the web P and changing the web P conveying speed.

Namely, the web P is conveyed into the processing liquid coating section 30 on the conveying direction downstream side while the web P stretched between the in-feed roller pair 21 and the dancer roller 22 performs the role of a paper accumulation section for temporarily storing the web P when the throw distance between the in-feed roller pair 21 and the dancer roller 22 is at its greatest. The throw distance between the in-feed roller pair 21 and the dancer roller 22 is narrowed when the web P is temporarily not being fed out from the paper feeder section 10, such as during web P splicing.

(Processing Liquid Coating Section)

As shown in FIG. 1, a coating roller unit 31 is disposed in the processing liquid coating section 30 for coating processing liquid onto the recording face of the web P (the face to be recorded with an image, at the topside in the drawing) for causing an aggregation reaction with ink droplets that impact in the image forming section 50, described later. The processing liquid that is coated includes an aggregation agent that causes the components in the ink composition to aggregate.

By coating the processing liquid an aggregation reaction is caused to occur between the ink and processing liquid on the recording face of the web P after image recording, thereby enabling high quality images to be formed, without problems or image damage occurring, such as bleeding, impact interference (merging) or color fading.

Compounds that may be employed as the aggregation agent include compounds capable of changing the pH of the ink composition, poly-valent metal salts, and poly-aryl amines. Preferable examples of compounds that lower pH may include acidic substances with high water solubility (such as phosphoric acid, oxalic acid, malonic acid and citric acid, and derivatives or salts thereof). A single acidic substance may be used on its own, or two or more types of acidic substance may be used in combination. The aggregating ability is raised thereby and the whole of the ink is solidified. Preferably the pH (25° C.) of the processing liquid is within the range of pH 0.5 to 4 when the pH (at 25° C.) of the ink composition is 8.0 or higher. This enables good image density and resolution, and higher speeds of inkjet recording to be achieved.

Other additives may be included in the processing liquid (such as known additives like a drying inhibitor (wetting agent), an anti-fading agent, an emulsion stabilizer, a penetration promoting agent, an ultraviolet absorber, an antiseptic agent, an antifungal agent, a pH regulator, a surface tension regulator, a defoaming agent, a viscosity regulator, a dispersant, a dispersion stabilizer, a rust preventing agent and/or a chelating agent).

(First Drying Section)

As shown in FIG. 1, dancer rollers 41 are provided in the first drying section 40 for adjusting the tension of the web P. The dancer rollers 41 are swung up or down in the drawing and held by an actuator, not shown in the drawings, in order to temporarily store the web P of an adjustment amount required during splicing the web P and changing the web P conveying speed. A heating and drying configuration is adopted by blowing heated air at the web P from a hot air device, not shown in the drawings, onto the web P entrained between the dancer rollers 41.

Configuration may be made such that the amount of air and the temperature of the air in the heated air of the first drying section is weaker (lowered) during acceleration and deceleration, as described later. This is performed to prevent over drying, since more time is required to pass through the first drying section 40 during acceleration or deceleration than the conveying time (recording time) at normal speed.

(Image Forming Section)

As shown in FIG. 1, the image forming section 50 is provided with a single or multiple recording heads 51 positioned facing the recording face of the web P.

In the example shown in FIG. 1 an image is formed by four of the recording heads 51 jetting ink droplets of each color, C, M, Y and K, onto the recording face of the web P. Flapping of the web P is suppressed by imparting tension to the web P by forming the recording face side of the web P conveying path in a bowed convex shape, and a clearance can be secured between each of the recording heads 51 and the recording face.

The ink jetted by the recording heads 51 is, for example, a water based ultraviolet-curing ink, containing pigment, polymer particles and a water soluble polymerizable compound that polymerizes under the action of actinic radiation. The water based ultraviolet-curing ink is curable on illumination with ultraviolet radiation, and forms an image on the recording face with a high strength film with high durability.

As an example, the pigment employed is a water dispersible pigment having at least a portion of the surface covered with a polymer dispersant. The polymer dispersant preferably has an acid number in the range of 25 to 100 KOH mg/g. This gives good stability of self dispersibility as well as giving good aggregation ability when in contact with the processing liquid. The polymer particles are preferably self dispersing polymer particles with an acid number of 20 to 50 KOH mg/g. An ink can thereby be achieved with good stability of self dispersibility as well as having good aggregation ability when in contact with the processing liquid.

The polymerizable compound is preferably a non-ionic or cationic polymerizable compound from the perspective of avoiding reaction between the aggregation agent and the pigment, and with the polymer particles, and a polymerizable compound with a solubility in water of 10% by weight or greater is preferable (15% by weight or greater is more preferable).

Configuration may be made such that at least one or other of the ink composition and/or the processing liquid further includes an initiator for initiating polymerization of the polymerizable compound under the action of actinic radiation. The initiator can be appropriately selected to include a compound that initiates a polymerization reaction under the action of actinic radiation. For example an initiator that generates an active species (such as a radical, acid, salt) on irradiation with radiation, light or an electron beam (for example a photopolymerization initiator).

The ink may contain water at between 50% and 70% by weight. In addition a water soluble organic solvent and other known additive agents may be added, such as a drying inhibitor (wetting agent), an anti-fading agent, an emulsion stabilizer, a penetration promoting agent, an ultraviolet absorber, an antiseptic agent, an antifungal agent, a pH regulator, a surface tension regulator, a defoaming agent, a viscosity regulator, a dispersant, a dispersion stabilizer, a rust preventing agent and/or a chelating agent (Second Drying Section)

As shown in FIG. 1, the second drying section 60 has fundamentally the same configuration as the first drying section 40, and dancer rollers 61 are provided for adjusting the tension of the web P. The dancer rollers 61 are swung up or down in the drawing and held by an actuator, not shown in the drawings, in order to temporarily store the web P of an adjustment amount required during splicing the web P and when changing the web P conveying speed. A heating and drying configuration is adopted by blowing heated air at the web P from a hot air device, not shown in the drawings, onto the web P entrained between the dancer rollers 61.

Similarly to in the first drying section, configuration may be made such that the amount of air and the temperature of the air in the heated air of the second drying section is weaker (lower) during acceleration and deceleration, as described later. This is performed to prevent over drying, since more time is required to pass through the second drying section 60 during acceleration or deceleration than the conveying time (recording time) at normal speed.

(Fixing and Reading Section)

As shown in FIG. 1, an ultraviolet radiation illumination light source 71 is provided in the fixing and reading section 70 for solidifying aggregated bodies of the processing liquid and ink by application of ultraviolet radiation to the recording face of the web P after image forming. A cooling device 72 is provided at the conveying direction downstream side of the ultraviolet radiation illumination light source 71 for then cooling the web P to an appropriate temperature and fixing.

The cooling device 72 is equipped with plural cooling rollers 73, and the web P looses heat transferred from the web P being conveyed between the plural cooling rollers 73 by contact with the cooling rollers 73, thereby cooling the web P.

After an image has been fixed to the recording face, a scanner 74 then scans the image on the recording face and feedbacks data during forming images on the recording face of the image forming section 50 to a control section, not shown in the drawings, for detecting poor jetting due to malfunction of the recording heads 51, detecting any misalignment of the impact position or misalignment in density, in order to perform correction and adjustment.

(Out-Feed Section)

As shown in FIG. 1, an out-feed roller pair 81 is provided in the out-feed section 80 for pulling the web P out of the fixing and reading section 70. The rotation speed of the out-feed roller pair 81 can be set as desired. A dancer roller 82 is provided for adjusting the tension of the web P. The dancer roller 82 is swung up or down in the drawing and held by an actuator, not shown in the drawings, in order to temporarily store the web P of an adjustment amount required during splicing the web P and changing the web P conveying speed.

Namely, the web P is conveyed out to the take-up section 90 on the conveying direction downstream side while the web P stretched between the out-feed roller pair 81 and the dancer roller 82 performs the role of a paper accumulation section for temporarily storing the web P when the throw distance between the out-feed roller pair 81 and the dancer roller 82 is at its greatest. The throw distance between the out-feed roller pair 81 and the dancer roller 82 is narrowed when the web P is not being fed out from upstream, such as during web P splicing.

(Take-Up Section)

As shown in FIG. 1, the take-up section 90 is provided with a reel stand 94 to which plural winding cores 91 are mounted. During take-up of the web P the arms of the reel stand 94 are rotated in a counter-clockwise direction such that one of the winding cores 91 approaches the conveying path of the web P. After the web P has been spliced by a core splicer, not shown in the drawings, by pressing the web P against an adhesive portion on the winding core 91, the roll 92 and the web P are then parted by a cutter of the core splicer. The conveyed web P is thereby wound onto the winding cores 91, in sequence, and taken up. Configuration may be made such that a folding mechanism is provided in place of the winding cores 91, and the web P is collected in a folded state rather than roll form.

(Recording Head Position Varying Mechanism)

In the image recording apparatus 100 according to the present invention, the recording heads 51 of the image forming section 50 are equipped with a moving mechanism such as in the examples described below, and are supported so as to be capable of moving in an approach-separation direction with respect to the conveyed face of the web P. Accordingly a configuration is achieved with variable throw distance (TD).

Figure 2A:
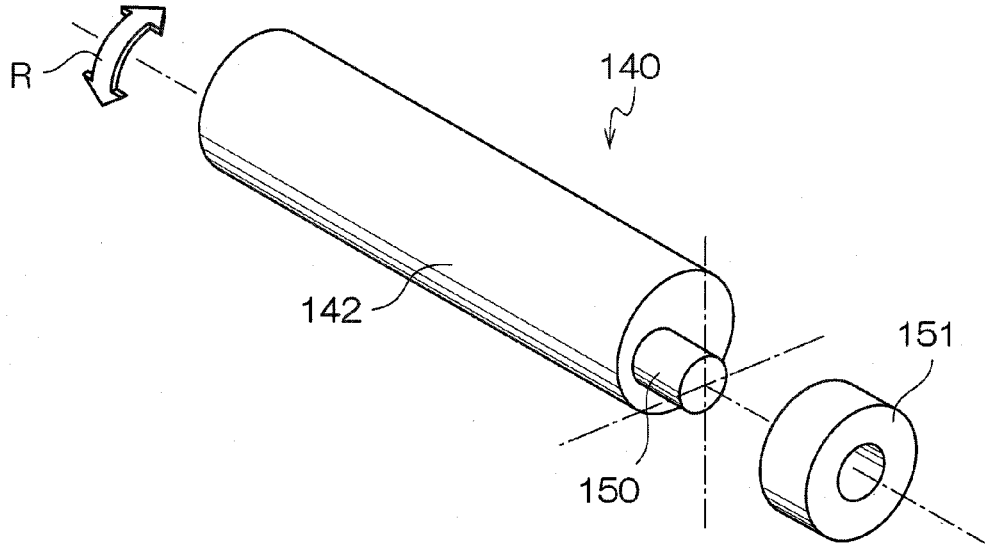
FIG. 2A is a perspective view illustrating a recording head raising and lowering mechanism according to an exemplary embodiment of the present invention.
Figure 2B:
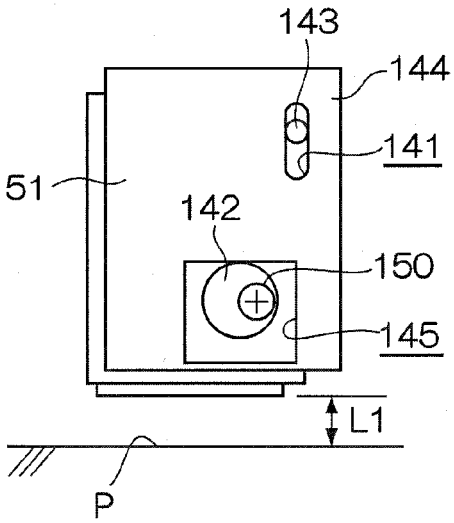
FIG. 2B is a side view illustrating the recording head raising and lowering mechanism according to an exemplary embodiment of the present invention.
Figure 2C:
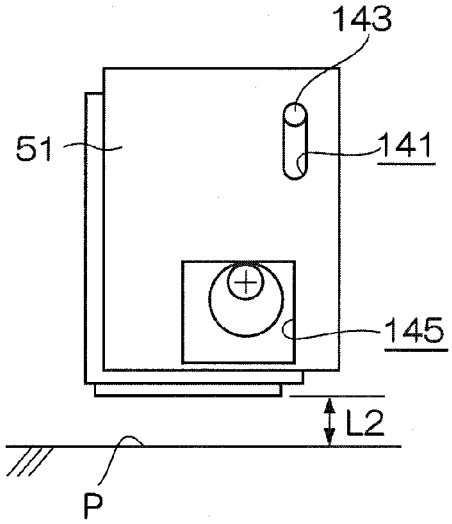
FIG. 2C is a side view illustrating the recording head raising and lowering mechanism according to an exemplary embodiment of the present invention.

For example, the configuration may be such that the recording heads 51 are raised or lowered (moved away from or towards the recording face of the web P) by a raising and lowering mechanism 140 as shown in FIG. 2A to FIG. 2C.

The raising and lowering mechanism 140 is equipped with an eccentric cam core 142 rotatably supported in a shaft bearing 151 so as to rotate about an eccentric rotation shaft 150 as shown in FIG. 2A. The eccentric cam core 142 is inserted through a support hole 145 provided in each of the recording heads 51, as shown in the side view of FIG. 2B. The support hole 145 passes through each of the recording heads 51 along a direction parallel to the recording face of the web P, such that the eccentric cam core 142 is rotatable inside the support hole 145.

The eccentric cam core 142 is rotated by drive means such as a stepping motor (not shown in the drawings), and the TD can be changed from the TD of FIG. 2B (indicated in the drawing as L1) to, for example, the TD of FIG. 2C (indicated in the drawing as L2) by raising the inside wall of the support hole 145.

In order to prevent disturbance to the orientation of the recording head 51 resulting from such changes in TD, the configuration may be such that each of the recording heads 51 is provided with a guide pin 143 on the side of the device main body, which is inserted through an elongated hole 141 provided along the web P approach-separation direction of the recording head 51. A configuration is thereby achieved in which each of the recording heads 51 only moves in the web P approach-separation direction when the eccentric cam core 142 rotates.

Figure 3A:
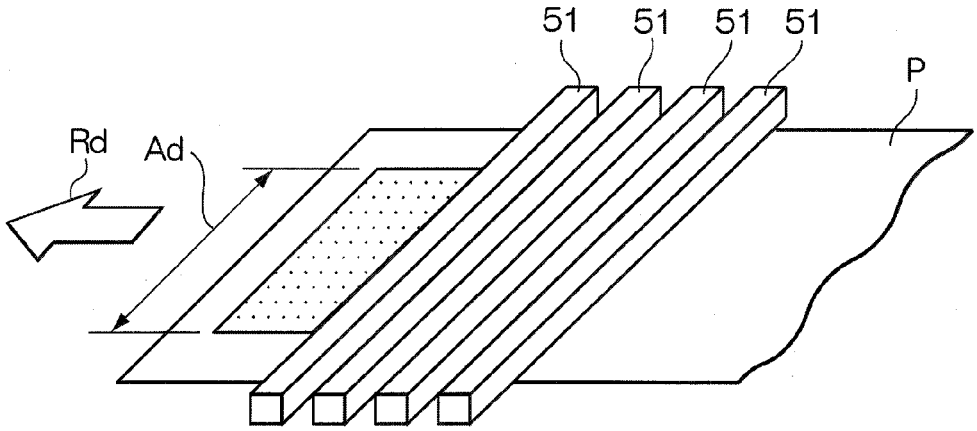
FIG. 3A is a perspective view illustrating a recording head raising and lowering mechanism according to another exemplary embodiment of the present invention.
Figure 3B:
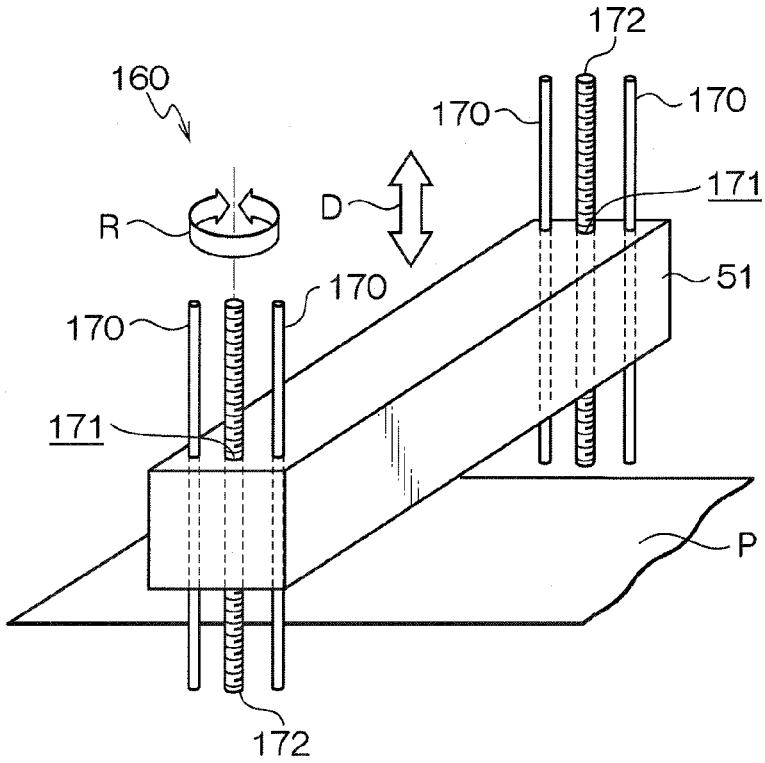
FIG. 3B is a perspective view illustrating the recording head raising and lowering mechanism according to another exemplary embodiment of the present invention.

Alternatively, the configuration may be such that the recording heads 51 are raised or lowered (moved away from or toward the recording face of the web P) using another example of a raising and lowering mechanism 160 as shown in FIG. 3A and FIG. 3B.

When a recording head 51 is provided, as shown in FIG. 3A, that covers the print width Ad by covering the web P in the conveying width direction with respect to the web P conveying direction (indicated as Rd in the drawing), the weight and inertia of the recording head 51 becomes large, increasing the length required for the eccentric cam core 142. However this issue can be addressed by employing the raising and lowering mechanism 160 as illustrated in FIG. 3B.

For example, as shown in FIG. 3B, guide pins 170 are provided at both length direction ends of the recording head 51 so as to run along the approach-separation direction with respect to the web P. The guide pins 170 pass through the recording head 51 and enable the recording head 51 to be moved along the approach-separation (lowering-raising) direction.

Shafts 172 that also extend in the approach-separation direction mesh with threaded holes 171 provided so as to pass through the recording head 51 in the approach-separation direction. The shafts 172 are rotationally driven, for example by a stepping motor (not shown in the drawings). The outer peripheral faces of the shafts 172 are cut with a thread, enabling the recording heads 51 to be moved in the arrow D direction (the approach-separation direction) by rotating the shafts 172 while threadably engaged with the threaded holes 171 in the arrow R direction in the drawings.

In such a configuration, since the required length of the shafts 172 is the same irrespective of the total length of the recording heads 51, providing the threaded holes 171 at the two length direction ends of each of the recording heads 51 enables the recording heads 51 to be raised or lowered without any problems, even when the recording heads 51 are long and/or heavy.

(Operational Effect: Recording Head Position and Conveying Speed)

The image recording apparatus according to the present invention has the following relationships between the position of the recording heads 51 and the conveying speed of the recording medium and the recording density (frequency).

Figure 4A:
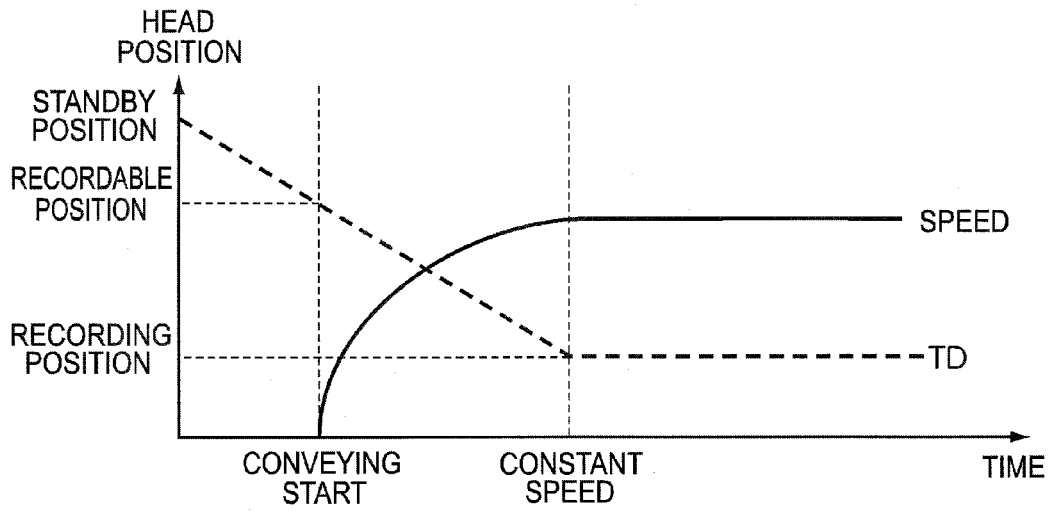
FIG. 4A is a graph showing changes with time in a position of a recording head and a conveying speed of a recording medium during acceleration of the recording medium according to an exemplary embodiment of the present invention.
Figure 4B:
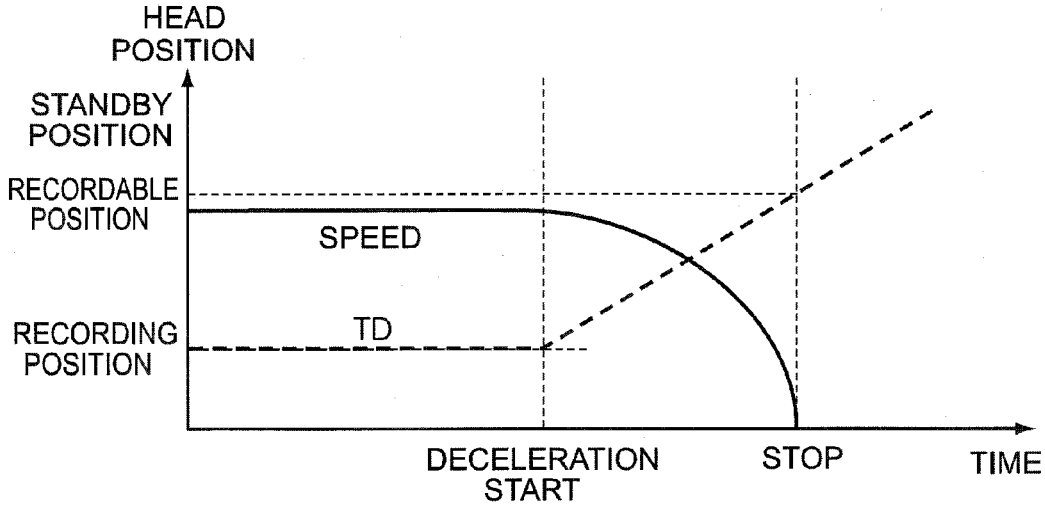
FIG. 4B is a graph showing changes with time in a position of the recording head and a conveying speed of the recording medium during deceleration of the recording medium according to an exemplary embodiment of the present invention.

Explanation follows regarding an operation flow from the start to the completion of recording, with reference to FIG. 4A and FIG. 4B.

As shown in FIG. 4A, when recording by the recording head 51 is initiated, the recording heads 51 starts to move in the approach-separation direction, descending from the standby position so as to approach the recording face. Conveying (acceleration) of the web P (continuous paper) is started when a printable position is reached (for example TD=2 mm).

When conveying of the web P has started (the recording medium is accelerated) the recording heads 51 are lowered towards a target recording position so as to further approach the recording face, and while this is taking place liquid droplets are jetted from the recording heads 51 and printing is executed with respect to the web P (recording paper). Printing can accordingly be performed before the conveying speed of the web P reaches a constant speed (the conveying speed set as the normal printing speed), and the recording face of the web P that passes during the acceleration period can be printed on. A reduction of lost paper on which conventionally it would not be possible to record is thereby enabled.

The following two features are implemented. Namely, acceleration of the web P is performed such that acceleration reduces over time (specific speed: converging towards the constant speed). Due to configuration with such an acceleration profile, smaller changes are made to the conveying speed of the web P when the TD is already small, thereby suppressing flapping of the web P. The possibility of contact or interference between the recording face of the web P and the recording heads 51 can accordingly be suppressed.

The jetting frequency (=recording frequency) from the recording heads 51 during this period is made to vary with time according to the speed of the web P and the TD. Namely, the jetting interval Δt (ms) and jetting frequency f(t) (kHz) are as illustrated in FIG. 5, wherein the recording density is indicated as P (dpi), the conveying speed of the web P is indicated as v(t) (m/s), TD is indicated as h(t) (mm) and the liquid droplet speed is indicated as V (m/s).

The jetting interval Δt (ms) and the jetting frequency f(t) (kHz) are as shown in FIG. 5 for the examples from the $N^{th}$ droplet ejection (t0) and impact (t1) to the $N+1^{th}$ droplet ejection (t2) and impact (t3):

$$\text{Jetting interval } \Delta t = t2 - t0 = (h(t0) - h(t2))/V + 25.4/P < v(t0,t2) >$$

$$\text{Jetting frequency } f = 1/\Delta t = 1/\{(h(t0) - h(t2))/V + 25.4/P < v(t0,t2) >$$

Printing is executed with the conveying speed and jetting frequency (recording frequency) set as normal printing speed onwards from the point when the web P reaches the constant speed and the recording heads 51 have arrived at the recording position (for example TD=1 mm).

As shown in FIG. 4B, as printing approaches completion, the web P is decelerated, and at the same time the recording heads 51 are raised along the approach-separation direction, such that the throw distance (TD) between the recording heads 51 and the web P is increased. Liquid droplets are jetted from the recording heads 51 and printing is executed with respect to the web P during deceleration similarly to during acceleration.

Printing can accordingly be performed on the web P that passes during deceleration, enabling a reduction in lost paper. There is a possibility of the web P flapping during deceleration; however, due to the throw distance (TD) between the recording heads 51 and the recording medium separating there is a lower possibility of contact or interference of the recording face of the web P with the recording heads 51 compared to during acceleration. Finally, conveying of the web P is stopped when recording is completed, and the recording heads 51 are returned to the standby position (initial position).

(Other)

While explanation has been given above of exemplary embodiments of the present invention, the present invention is not limited to the above exemplary embodiments, and obviously various modifications may be implemented within a range not departing from the spirit of the present invention.

For example, while explanation has been given of examples of configurations in the above exemplary embodiments in which a web P of a continuous long strip of paper is conveyed there is no limitation thereof and, for example, a recording medium of single sheets may be employed. Namely, when a specific conveying speed (constant speed) has still not yet been achieved when the leading edge of the recording medium at the start of conveying reaches the recording position facing the recording heads 51, recording can still be enabled for the duration from when the TD is large and the jetting frequency is low up to when the constant speed is achieved. Similarly, recording can still be enabled for the duration from when the TD is small and the jetting frequency is high up to when conveying is stopped.

Accordingly an excellent feature is exhibited in that there is no need for a "flying start" during acceleration to the conveying speed when employing single sheet recording paper, and since processing can be completed while decelerating, the trailing edge portion of the recording paper is not exposed during paper discharge.

Furthermore, there is no limitation to ink for image recording and printing text as the liquid for jetting, and application can also be made, for example, to forming a base plate pattern when etching.

Various recording methods may also be employed for image recording, such as a thermal transfer method or a dot impact method.

What is claimed is:

1. An image recording apparatus comprising:

a conveying unit that conveys a recording medium;

a conveying speed detection unit that detects a conveying speed of the recording medium;

a conveying control unit that controls the conveying unit so as to accelerate or decelerate the conveying speed of the recording medium detected by the conveying speed detection unit between a stationary state and a constant speed state;

a recording unit that faces the recording medium and records an image;

a recording control unit that varies a recording frequency of the recording unit according to the conveying speed of the recording medium; and a throw distance control unit that controls a throw distance between the recording unit and a recording face of the recording medium according to the conveying speed of the recording medium.

2. The image recording apparatus of claim 1, wherein during acceleration of the recording medium the recording unit records the image while the throw distance control unit decreases the throw distance between the recording unit and the recording medium.

3. The image recording apparatus of claim 1, wherein during deceleration of the recording medium the recording unit records the image while the throw distance control unit increases the throw distance between the recording unit and the recording medium.

4. The image recording apparatus of claim 1, wherein during acceleration of the recording medium a rate of change in speed decreases as the conveying speed increases.

5. The image recording apparatus of claim 1, wherein during deceleration of the recording medium a rate of change in speed increases as the conveying speed decreases.

6. The image recording apparatus of claim 1, wherein during acceleration or deceleration of the recording medium the conveying control unit and the recording control unit change a recording frequency according to the throw distance between the recording unit and the recording medium.

7. The image recording apparatus of claim 1, wherein:

the throw distance control unit changes a position of the recording unit in at least three stages that include a standby position at a greatest throw distance from the recording medium, a recordable position that is closer to the recording medium than the standby position, and a recording position that is closer to the recording medium than the recordable position;

while the recording unit is positioned between the standby position and the recordable position, the conveying control unit stops conveying of the recording medium;

while the recording unit is positioned between the recordable position and the recording position, the conveying control unit accelerates or decelerates the recording medium and the recording control unit makes the recording unit record the image on the recording face while changing the recording frequency of the recording unit; and while the recording unit is positioned at the recording position, the conveying control unit conveys the recording medium at a constant speed and the recording control unit makes the recording unit record the image on the recording face while maintaining a constant recording frequency of the recording unit.

8. The image recording apparatus of claim 1, further comprising a drying unit that heats and dries the recording medium after image recording, wherein an intensity of drying of the drying unit is lower during acceleration or deceleration of the recording medium than during conveying at a constant speed.

9. The image recording apparatus of claim 1, further comprising a processing liquid coating unit that coats a processing liquid to the recording face and a processing liquid drying unit that dries the processing liquid applied to the recording face before image recording, wherein an intensity of drying of the processing liquid drying unit is lower during acceleration or deceleration of the recording medium than during conveying at a constant speed.

10. The image recording apparatus of claim 1 wherein the recording medium conveyed by the conveying unit is continuous paper.

11. The image recording apparatus of claim 1 wherein:

the throw distance control unit is a raising and lowering mechanism that raises or lowers the recording unit;

the recording unit comprises a recording head with a support hole that passes through the recording head and is parallel to the recording face of the recording unit; and the raising and lowering mechanism comprises an eccentric cam core with an eccentric rotating shaft that is inserted rotatably into the support hole.

12. The image recording apparatus of claim 11 wherein:

an elongated hole is formed in the recording head along a raising and lowering direction of the raising and lowering mechanism; and the raising and lowering mechanism comprises a guide pin that is inserted into the elongated hole, wherein the guide pin effects guidance such that the recording head only moves in the raising and lowering direction.

13. The image recording apparatus of claim 1, wherein:

the throw distance control unit is a raising and lowering mechanism that raises or lowers the recording unit;

the recording unit comprises a recording head with a threaded hole that passes through the recording head in a raising and lowering direction of the raising and lowering mechanism; and the raising and lowering mechanism comprises a shaft that extends in the raising and lowering direction and that is threadably engaged with the threaded hole.

14. The image recording apparatus of claim 13, wherein:

the raising and lowering mechanism further comprises a guide pin that passes through an end portion of the recording head in the raising and lowering direction, and the guide pin effects guidance such that the recording head only moves in the raising and lowering direction.

15. An image recording method comprising:

conveying a recording medium;

detecting a conveying speed of the recording medium;

accelerating or decelerating the detected conveying speed of the recording medium between a stationary state and a constant speed state;

recording an image with a recording unit disposed facing the recording medium;

varying a recording frequency of the recording unit according to the conveying speed of the recording medium; and controlling a throw distance between the recording unit and a recording face of the recording medium according to the conveying speed of the recording medium.

16. The image recording method of claim 15, wherein during the accelerating of the recording medium the recording unit records the image while the throw distance between the recording unit and the recording medium decreases.

17. The image recording method of claim 15, wherein during the decelerating of the recording medium the recording unit records the image while the throw distance between the recording unit and the recording medium increases.

18. The image recording method of claim 15, wherein during the accelerating of the recording medium a rate of change in speed decreases as the conveying speed increases.

19. The image recording method of claim 15, wherein during the decelerating of the recording medium a rate of change in speed increases as the conveying speed decreases.

20. The image recording method of claim 15, wherein during the accelerating or decelerating of the recording medium a recording frequency is changed according to the throw distance between the recording unit and the recording medium.

21. The image recording method of claim 15, wherein:

a position of the recording unit is changed in at least three stages that include a standby position at a greatest throw distance from the recording medium, a recordable position that is closer to the recording medium than the standby position, and a recording position that is closer to the recording medium than the recordable position;

while the recording unit is positioned between the standby position and the recordable position, the conveying of the recording medium is stopped;

while the recording unit is positioned between the recordable position and the recording position, the recording medium is accelerated or decelerated and the recording unit records the image on the recording face while the recording frequency of the recording unit is changed; and while the recording unit is positioned at the recording position, the recording medium is conveyed at a constant speed and the recording unit records the image on the recording face while a constant recording frequency is maintained.

22. The image recording method of claim 15, further comprising heating and drying the recording medium after image recording, wherein an intensity of the drying is lower during acceleration or deceleration of the recording medium than during conveying at a constant speed.

23. The image recording method of claim 15, further comprising coating a processing liquid to the recording face and drying the processing liquid applied to the recording face before image recording, wherein an intensity of the drying of the processing liquid is lower during acceleration or deceleration of the recording medium than during conveying at a constant speed.

* * * * *